US009172142B2

(12) United States Patent
Sudo et al.

(10) Patent No.: US 9,172,142 B2
(45) **Date of Patent: *Oct. 27, 2015**

(54) HORIZONTAL RADIATION ANTENNA

(75) Inventors: Kaoru Sudo, Nagaokakyo (JP); Hirotaka Fujii, Nagaokakyo (JP); Eiichi Kobayashi, Nagaokakyo (JP); Toshiro Hiratsuka, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 17 days.

This patent is subject to a terminal disclaimer.

(21) Appl. No.: 13/415,298

(22) Filed: Mar. 8, 2012

(65) Prior Publication Data

US 2012/0229356 A1 Sep. 13, 2012

(30) Foreign Application Priority Data

Mar. 9, 2011 (JP) ..... 2011-051496

(51) Int. Cl.
*H01Q 9/04* (2006.01)
*H01Q 1/48* (2006.01)
*H01Q 19/00* (2006.01)
(Continued)

(52) U.S. Cl.
CPC ..... *H01Q 9/0407* (2013.01); *H01Q 1/48* (2013.01); *H01Q 19/005* (2013.01); *H01Q 19/28* (2013.01); *H01Q 21/06* (2013.01)

(58) Field of Classification Search
CPC ..... H01Q 1/38; H01Q 1/48; H01Q 9/0407; H01Q 19/005; H01Q 19/28; H01Q 19/30
USPC ..... 343/700 MS, 755, 829, 841, 846, 912
See application file for complete search history.

(56) References Cited

U.S. PATENT DOCUMENTS 6,046,703 A 4/2000 Wang et al.
6,680,712 B2 * 1/2004 Yamamoto et al. ..... 343/789
(Continued)

FOREIGN PATENT DOCUMENTS

CN 1369930 A 9/2002
JP 06-204734 7/1994
(Continued)

OTHER PUBLICATIONS

Sergio E. Melais et al.; "A Quasi Yagi Antenna Backed by a Metal Reflector"; IEEE Transactions on Antennas and Propagation, vol. 56, No. 12, pp. 3868-3872; Dec. 30, 2008.
(Continued)

*Primary Examiner* — Robert Karacsony
*Assistant Examiner* — Daniel J Munoz
(74) *Attorney, Agent, or Firm* — Studebaker & Brackett PC

(57) ABSTRACT

This disclosure provides a horizontal radiation antenna. The antenna includes a back-surface-side grounded conductor plate on a back surface of a substrate, a radiation element to which a coplanar line is connected on the front surface of the substrate, and a passive element closer to an end portion side of the substrate than the radiation element. A front-surface-side grounded conductor plate is provided at a substantially same height as the radiation element with respect to a thickness direction of the substrate, and a conductive wall surface capable of reflecting a high-frequency signal radiated from the radiation element is provided between the front-surface-side grounded conductor plate and the back-surface-side grounded conductor plate.

10 Claims, 10 Drawing Sheets

(51) Int. Cl.
*H01Q 19/28* (2006.01)
*H01Q 21/06* (2006.01)

(56) References Cited

U.S. PATENT DOCUMENTS

| | | | | |
|---|---|---|---|---|
| 7,154,441 | B2 * | 12/2006 | Hansen et al. | 343/700 MS |
| 7,372,408 | B2 * | 5/2008 | Gaucher et al. | 343/700 MS |
| 7,551,140 | B2 * | 6/2009 | Knadle et al. | 343/700 MS |
| 2002/0135522 | A1 | 9/2002 | Yamamoto et al. | |
| 2007/0262828 | A1 * | 11/2007 | Fujita | 333/26 |
| 2011/0032155 | A1 * | 2/2011 | Yanagi et al. | 343/700 MS |
| 2011/0057853 | A1 * | 3/2011 | Kim et al. | 343/843 |
| 2011/0063187 | A1 * | 3/2011 | Huang | 343/893 |
| 2011/0133991 | A1 * | 6/2011 | Lee et al. | 343/700 MS |
| 2012/0098706 | A1 * | 4/2012 | Lin et al. | 343/700 MS |

FOREIGN PATENT DOCUMENTS

| | | | |
|---|---|---|---|
| JP | 2007-311944 | A | 11/2007 |
| JP | 2011-024183 | A | 2/2011 |
| WO | 2006/038432 | A1 | 4/2006 |

OTHER PUBLICATIONS

Japanese Office Action "Notification of Reason for Rejection" dated Apr. 23, 2013, which corresponds to Japanese Patent Application No. 2011-051496 and is related to U.S. Appl. No. 13/415,298, with translation.

William Deal et al,; "A New Quasi-Yagi Antenna for Planar Active Antenna Arrays"; vol. 48. Issue 6; pp. 910-918; Jun. 2000.

The first Office Action issued by the State Intellectual Property Office of People's Republic of China on Dec. 10, 2013, which corresponds to Chinese Patent Application No. 201210054991.2 and is related to U.S. Appl. No. 13/415,298.

The Second Office Action issued by the State Intellectual Property Office of People's Republic of China on May 30, 2014, which corresponds to Chinese Patent Application No. 201210054991.2 and is related to U.S. Appl. No. 13/415,298; with English language translation.

An Office Action; "Rejection Decision," issued by the State Intellectual Property Office of People's Republic of China on Oct. 10, 2014, which corresponds to Chinese Patent Application No. 201210054991.2 and is related to U.S. Appl. No. 13/415,298; with English language translation.

* cited by examiner

HORIZONTAL RADIATION ANTENNA

CROSS REFERENCE TO RELATED APPLICATIONS

The present application claims priority to Japanese Patent Application No. 2011-051496 filed Mar. 9, 2011, the entire contents of which is incorporated herein by reference.

FIELD OF THE INVENTION

The present invention relates to a horizontal radiation antenna suitable for use for a high-frequency signal such as a microwave, a millimeter wave, or the like, for example.

BACKGROUND

As a horizontal radiation antenna of the related art, in W. R. Deal, N. Kaneda, J. Sor, Y. Qian, and T. Itoh, "A New Quasi-Yagi Antenna for Planar Active Antenna Arrays", IEEE Trans. Microwave Theory Tech., June 2000, Vol. 48, No. 6, pp. 910-918 (hereinafter, "DOC 1"), a configuration is described in which, while a feeding line, an unbalance-balance converter electrode (hereinafter, referred to as a balun electrode), a radiation element, a passive element, and the like are formed on the front surface of a dielectric substrate, a grounded conductor plate is formed on the back surface of the dielectric substrate.

In addition, in Japanese Unexamined Patent Application Publication No. 6-204734 (hereafter, "DOC 2"), a configuration is described in which, while a microstrip line used for power feeding and a conductive body cover are provided on the front surface of a dielectric substrate, a grounded conductor plate is provided on the back surface of the dielectric substrate. In this case, the leading end portion of the microstrip line is located on the end portion side of the dielectric substrate and electrically connected to the grounded conductor plate. In addition, while the conductive body cover is formed in a substantially box shape, one end side of which is open, and surrounds the leading end portion of the microstrip line, the peripheral portion thereof is electrically connected to the grounded conductor using a plurality of conductor pins. In addition, in cooperation with the end edge of the grounded conductor plate, the conductive body cover configures a slot whose length is about a half wavelength in a direction parallel to the dielectric substrate.

Furthermore, in Japanese Unexamined Patent Application Publication No. 2007-311944 (hereafter, "DOC 3"), a configuration is described in which, while, on the front surface of a dielectric substrate, a ground electrode is provided that has a notch portion whose end portion side is open, a feeding electrode is provided within the notch portion of the ground electrode. In this case, a slot line is formed owing to the outer peripheral edge of the feeding electrode and the inner peripheral edge of the ground electrode.

SUMMARY

The present disclosure provides a horizontal radiation antenna capable of being downsized and suppressing leak of electric power.

In one aspect of the disclosure, a horizontal radiation antenna includes a substrate including an insulating material, a back-surface-side grounded conductor plate on a back surface side of the substrate and connected to ground, a front-surface-side grounded conductor plate on a front surface side of the substrate and connected to ground, an elongated and thin radiation element on the front surface side of the substrate and facing the back-surface-side grounded conductor plate with being spaced therefrom, a feeding line including a conductor pattern provided on the front surface side of the substrate and connected to the radiation element, and at least one passive element closer to an end portion side of the substrate than the radiation element, extending in parallel with the radiation element, and be insulated from the back-surface-side grounded conductor plate, the front-surface-side grounded conductor plate, and the radiation element. The front-surface-side grounded conductor plate is disposed at a same position, or height as the radiation element with respect to a thickness direction of the substrate, and a conductive wall surface capable of reflecting a high-frequency signal radiated from the radiation element is provided between the front-surface-side grounded conductor plate and the back-surface-side grounded conductor plate.

In a more specific embodiment, the front-surface-side grounded conductor plate may include a substantially U-shaped frame portion surrounding the radiation element and the passive element in a state in which the end portion side of the substrate is open.

In another more specific embodiment, the feeding line may be configured using a coplanar line that includes a strip conductor as the conductor pattern provided on the front surface of the substrate and the front-surface-side grounded conductor plates provided on both sides in a width direction with sandwiching therebetween the strip conductor.

In yet another more specific embodiment, the wall surface may be configured using a plurality of vias that are provided so as to penetrate the substrate and electrically connect the front-surface-side grounded conductor plate and the back-surface-side grounded conductor plate to each other.

Other features, elements and characteristics will become more apparent from the following detailed description of exemplary embodiments with reference to the attached drawings.

DETAILED DESCRIPTION

Figure 1:
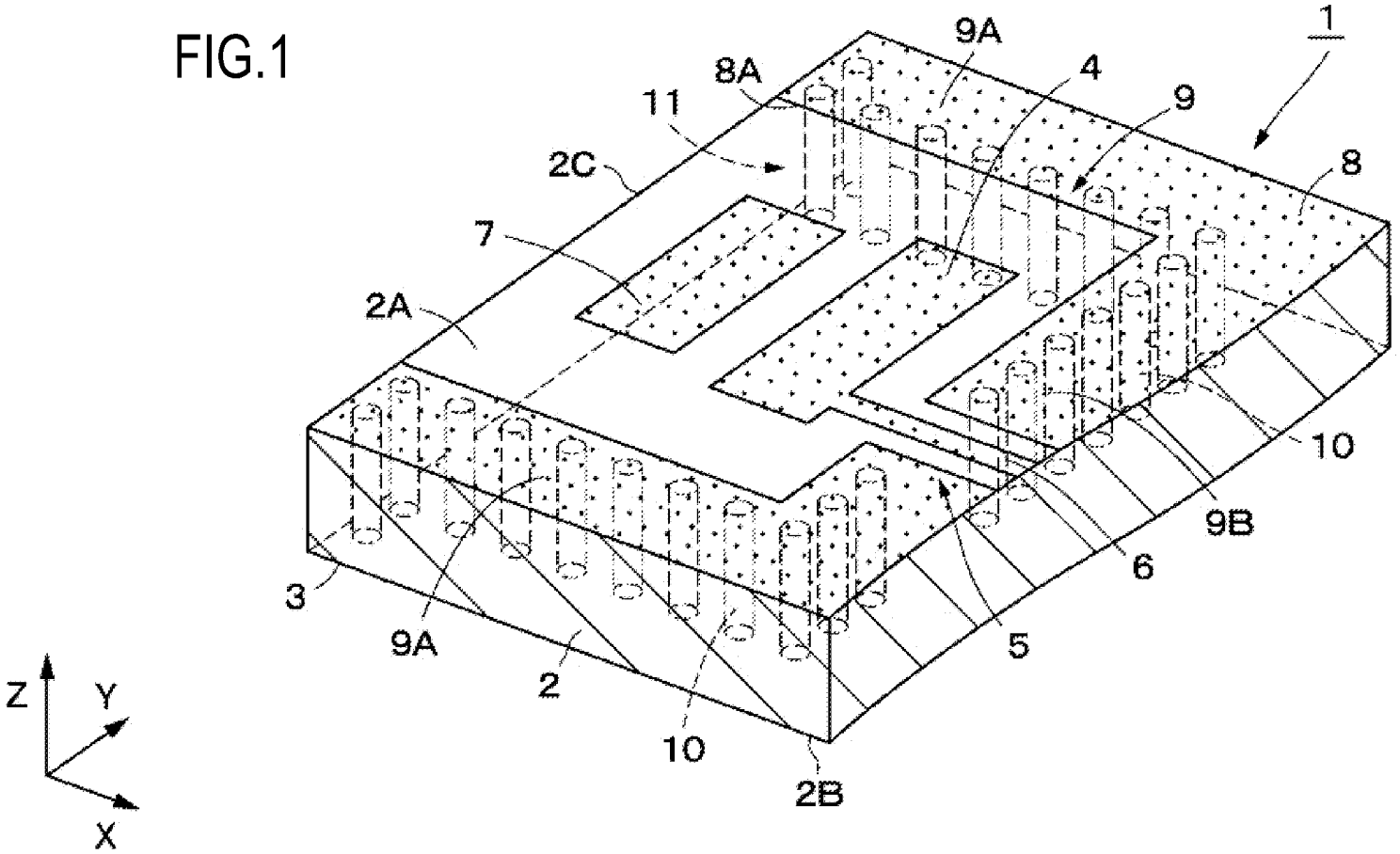
FIG. 1 is a perspective view illustrating a horizontal radiation antenna according to a first exemplary embodiment.

The inventors realized that in the antenna based on DOC 1, the balun electrode is formed in the feeding line, and in addition to this, the balun electrode is configured using two substantially U-shaped electrodes extending in a direction perpendicular to a direction in which the feeding line extends, and therefore, it is necessary to maintain a space used for forming the balun electrode, and the whole antenna tends to easily become large in size.

In addition, the inventors appreciated that in the antenna based on DOC 2, it is necessary to provide the conductive body cover independently of the dielectric substrate, and therefore, there occurs a problem that, while the antenna becomes large in size in the thickness direction of the dielectric substrate, a manufacturing cost increases with the structure thereof being complicated.

In addition, in the antenna based on DOC 3, a configuration is adopted in which, while the feeding electrode and the ground electrode are provided on the front surface of the dielectric substrate, the ground electrode is also provided on the back surface of the dielectric substrate. However, within the dielectric substrate, no configuration is provided that prevents an electromagnetic wave from propagating. Therefore, there is a problem that an electromagnetic wave of a parallel plate mode is formed between the ground electrode on a front surface side and the ground electrode on a back surface side and the electromagnetic wave propagates within the dielectric substrate, thereby causing electric power to leak.

Hereinafter, as a horizontal radiation antenna according to embodiments of the present disclosure, an antenna used in about a 60 GHz band will be cited as an example and described in detail with reference to accompanying drawings.

FIG. 1 to FIG. 4 illustrate a horizontal radiation antenna 1 according to a first exemplary embodiment. This horizontal radiation antenna 1 includes a substrate 2, a back-surface-side grounded conductor plate 3, a radiation element 4, a passive element 7, a front-surface-side grounded conductor plate 8, and the like, which are to be hereinafter described.

The substrate 2 is formed in a substantially plate shape extending parallel to an X axis direction and a Y axis direction, for example, from among the X axis direction, the Y axis direction, and a Z axis direction, perpendicular to one another. This substrate 2 can have a width dimension of about several mm with respect to the Y axis direction that corresponds to a width direction, for example, and can have a length dimension of about several mm with respect to the X axis direction that corresponds to a length direction, for example. In addition, the substrate 2 can have a thickness dimension of about several hundred μm with respect to the Z axis direction that corresponds to a thickness direction, for example.

For example, the substrate 2 can be formed using a resin material having an insulation property whose relative permittivity is about 4. For example, the thickness dimension of the substrate 2 can be set to about 700 μm. In addition, the substrate 2 is not limited to the resin material, and can also be formed, for example, using ceramic materials having insulation properties.

For example, the back-surface-side grounded conductor plate 3 can be formed using a conductive metal thin film such as copper, silver, or the like, and connected to a ground. This back-surface-side grounded conductor plate 3 is located on the back surface 2B of the substrate 2, and can cover approximately the whole surface of the substrate 2.

For example, the radiation element 4 can be formed in a substantially long and thin quadrangular shape, using a similar conductive metal thin film as that of the back-surface-side grounded conductor plate 3, and faces the back-surface-side grounded conductor plate 3 and spaced therefrom. Specifically, the radiation element 4 can be provided on the front surface 2A of the substrate 2. Between this radiation element 4 and the back-surface-side grounded conductor plate 3, the substrate 2 is sandwiched. Therefore, the radiation element 4 faces the back-surface-side grounded conductor plate 3 in a state in which the radiation element 4 is insulated from the back-surface-side grounded conductor plate 3.

Figure 2:
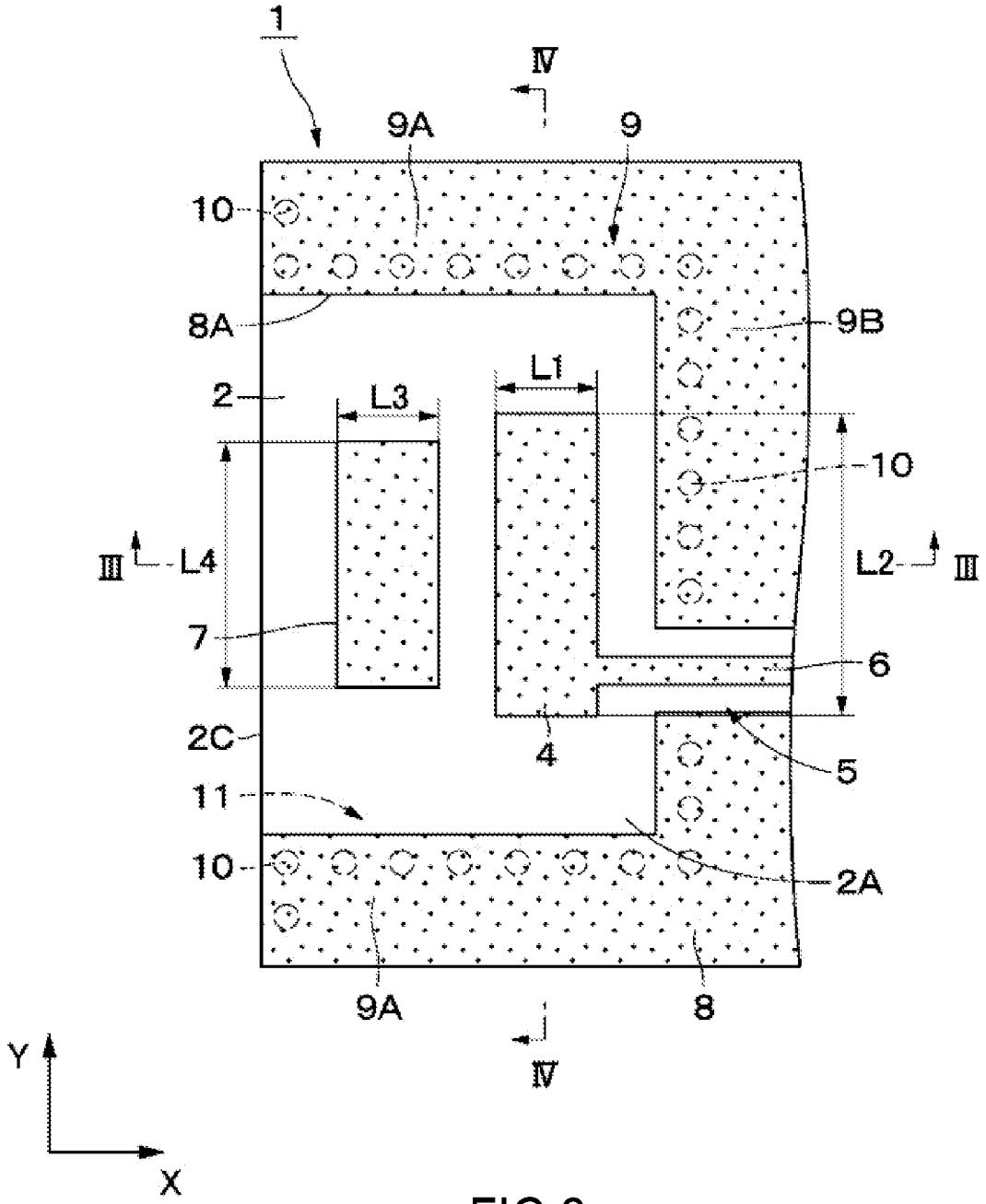
FIG. 2 is a plan view illustrating the horizontal radiation antenna in FIG. 1.
Figure 3:
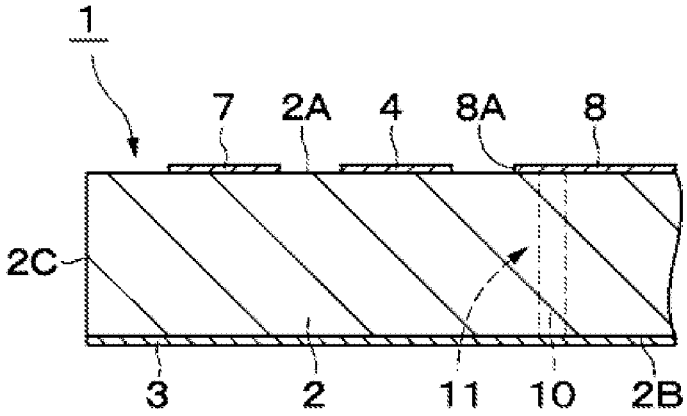
FIG. 3 is a cross-sectional view when the horizontal radiation antenna is viewed from a III-III direction indicated by arrows in FIG. 2.

In addition, as illustrated in FIG. 2, the radiation element 4 can have a length dimension L1 of about several hundred μm (for example, L1=about 450 μm) with respect to the X axis direction, and can have a width dimension L2 of about several hundred μm to about several mm (for example, L2=about 1450 μm) with respect to the Y axis direction. The width dimension L2 in the Y axis direction of this radiation element 4 can be a value larger than the length dimension L1, and can be set to a value corresponding to about the half wavelength of a used high-frequency signal in electrical length, for example.

Figure 4:
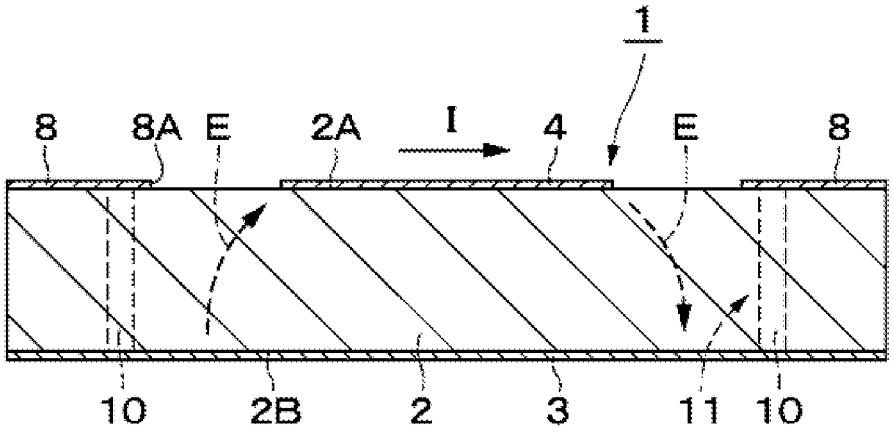
FIG. 4 is a cross-sectional view when the horizontal radiation antenna is viewed from a IV-IV direction indicated by arrows in FIG. 2.

Furthermore, a coplanar line 5 to be hereinafter described can be connected to the halfway position of the radiation element 4 in the Y axis direction. In addition, as illustrated in FIG. 4, owing to power feeding from the coplanar line 5, a current I flows in the Y axis direction in the radiation element 4. An electric field E is formed between both end portion sides in the Y axis direction in the radiation element 4 and the back-surface-side grounded conductor plate 3.

As illustrated in FIG. 1 and FIG. 2, the coplanar line 5 configures a feeding line performing power feeding on the radiation element 4. Specifically, the coplanar line 5 is configured by a strip conductor 6, which is provided on the front surface 2A of the substrate 2 and serves as a conductor pattern, and front-surface-side grounded conductor plates 8 to be hereinafter described, provided on both sides in the width direction (Y axis direction) with sandwiching therebetween the strip conductor 6. In addition, for example, the strip conductor 6 can include a similar conductive metal material as that of the back-surface-side grounded conductor plate 3, and can be formed in a substantially long and thin strip shape extending in the X axis direction. In addition, the leading end of the strip conductor 6 is connected to a halfway position located between a center position and an end portion position in the Y axis direction in the radiation element 4. In a more specific example, the leading end of the strip conductor 6 can be connected to a position having an offset of about 550 μm from the center position in the Y axis direction.

For example, the passive element 7 can be formed in a substantially long and thin quadrangular shape using a similar conductive metal thin film as that of the radiation element 4, and disposed on the end portion side 2C of the substrate 2, which is located on a leading end side in the X axis direction when being viewed from the radiation element 4. In the present example, a clearance gap is formed between this passive element 7 and the radiation element 4, the passive element 7 extends in the Y axis direction in a state in which the passive element 7 is parallel to the radiation element 4, and the passive element 7 is disposed in parallel to the radiation element 4. In addition, the passive element 7 is insulated from the radiation element 4, the back-surface-side grounded conductor plate 3, and the front-surface-side grounded conductor plate 8 to be hereinafter described.

In addition, the passive element 7 can have a length dimension L3 of about several hundred μm (for example, L3=about 450 μm) with respect to the X axis direction, and can have a width dimension L4 of about several hundred μm to about several mm (for example, L4=about 1150 μm) with respect to the Y axis direction. The width dimension L4 in the Y axis direction of this passive element 7 can be set to a value larger than the length dimension L3, and set to a value smaller than the width dimension L2 in the Y axis direction of the radiation element 4.

In addition, a magnitude relationship between the passive element 7 and the radiation element 4, the specific shapes thereof, the sizes thereof, and the like are not limited to the above-mentioned example, and may be arbitrarily set in response to the operating frequency band and the radiation pattern of the horizontal radiation antenna 1, the relative permittivity of the substrate 2, and the like. In addition, the passive element 7 causes electromagnetic field engagement with the radiation element 4 to occur, and functions as an inducer.

The front-surface-side grounded conductor plate 8 is provided on the front surface 2A of the substrate 2, and faces the back-surface-side grounded conductor plate 3. For example, this front-surface-side grounded conductor plate 8 can be formed using a conductive metal thin film, and electrically connected to the back-surface-side grounded conductor plate 3 using a plurality of vias 10 to be hereinafter described. Therefore, the front-surface-side grounded conductor plate 8 can be connected to the ground in a similar way as the back-surface-side grounded conductor plate 3.

In addition, in the front-surface-side grounded conductor plate 8, the present exemplary embodiment includes a substantially quadrangular-shaped notch portion 8A that is located on the end portion side 2C of the substrate 2 and whose leading end side in the X axis direction is open. In planar view of the horizontal radiation antenna 1, the radiation element 4 and the passive element 7 are disposed within the notch portion 8A. In addition, around the notch portion 8A, a substantially U-shaped frame portion 9 having a substantially U-shaped form surrounds the radiation element 4 and the passive element 7. This substantially U-shaped frame portion 9 is configured by two arm portions 9A, which are disposed on both sides in the Y axis direction with sandwiching therebetween the notch portion 8A and extend in the X axis direction. A width direction extension portion 9B located on the inner portion side of the notch portion 8A extends in the width direction (Y axis direction) between the two arm portions 9A. The width direction extension portion 9B is located on a base end side in the X axis direction, compared with the end portion side 2C of the substrate 2, and the halfway portion thereof in the Y axis direction is disconnected by the coplanar line 5.

For example, conductive metal material such as copper, silver, or the like can be provided in a through hole that penetrates the substrate 2 and whose internal diameter is of about several ten to about several hundred μm, and hence the via 10 is formed as a substantially columnar conductor. In addition, the via 10 extends in the Z axis direction, and both end portions thereof are connected to the back-surface-side grounded conductor plate 3 and the front-surface-side grounded conductor plate 8, respectively. A distance dimension between the two vias 10 adjacent to each other can be set to a value smaller than about the quarter-wavelength of a used high-frequency signal in electrical length, for example. In addition, the plural vias 10 are disposed along the edge portion of the substantially U-shaped frame portion 9 so as to surround the notch portion 8A. Accordingly, the plural vias 10 form a conductive wall surface 11 between the front-surface-side grounded conductor plate 8 and the back-surface-side grounded conductor plate 3.

In addition, the plural vias 10 stabilize the electric potentials of the back-surface-side grounded conductor plate 3 and the front-surface-side grounded conductor plate 8, and also functions as a reflector reflecting a high-frequency signal headed from the notch portion 8A to the inside of the substrate 2. Therefore, the vias 10 inhibit the high-frequency signal from leaking into the inside of the substrate 2.

The horizontal radiation antenna 1 according to the present exemplary embodiment has such a configuration as described above, and the operation thereof will now be described.

First, when power is fed from the coplanar line 5 to the radiation element 4, the current I flows in the radiation element 4 so as to be headed in the Y axis direction. Accordingly, the horizontal radiation antenna 1 transmits or receives a high-frequency signal depending on, or corresponding to the width dimension L2 of the radiation element 4.

Since the passive element 7 is provided in a state in which the passive element 7 is parallel to the radiation element 4, the radiation element 4 and the passive element 7 are electromagnetic-field-coupled to each other, and the current I also flows in the passive element 7 so as to be headed in the Y axis direction. Therefore, the passive element 7 functions as an inducer, it may be possible to obtain a directivity in the direction of the passive element 7 when being viewed from the radiation element 4, and it may be possible to radiate an electromagnetic wave from the end portion side 2C of the substrate 2 in a horizontal direction parallel to the substrate 2.

In addition, in the present embodiment, since the radiation element 4 is provided at a position facing the back-surface-side grounded conductor plate 3, radiation occurs in a state in which the back-surface-side grounded conductor plate 3 exists. Therefore, the balun electrode is not necessary that is described in DOC 1, it may be possible for the horizontal radiation antenna 1 to shorten a length dimension with respect to a power feeding direction (X axis direction) by about several mm (for example, about 2 mm), and it may be possible to establish downsizing.

In addition, in the antenna in DOC 2, since the conductor cover is used, the structure becomes stereoscopic. On the other hand, since the horizontal radiation antenna 1 according to the present exemplary embodiment has a structure capable of being formed in a substantially plane shape (planar) in the substrate 2, the structure is simple.

In addition, since the back-surface-side grounded conductor plate 3 and the front-surface-side grounded conductor plate 8 are connected to each other using the plural vias 10, and the conductive wall surface 11 is formed using these plural vias 10, this wall surface 11 serves as a reflector. As a result, it may be possible to improve a characteristic of radiating to the end portion side 2C of the substrate 2, on which the passive element 7 is disposed when being viewed from the radiation element 4. Furthermore, since an electromagnetic wave may be reflected by the wall surface 11 between the back-surface-side grounded conductor plate 3 and the front-surface-side grounded conductor plate 8, it may be possible to prevent electric power from leaking into the inside of the substrate 2.

In addition, since the front-surface-side grounded conductor plate 8 includes the substantially U-shaped frame portion 9 that surrounds, in a substantially U-shaped form, the radiation element 4 and the passive element 7 in a state in which the end portion side 2C of the substrate 2 is open, the conductive wall surface 11 between the back-surface-side grounded conductor plate 3 and the front-surface-side grounded conductor plate 8 is also formed in a substantially U-shaped form. Therefore, it may be possible to radiate an electromagnetic wave to the open end portion side 2C of the substrate 2, on which the substantially U-shaped frame portion 9 is open, and in addition to this, it may be possible to prevent a radiation pattern from diverging into both end portion sides in the width direction (i.e., the Y axis direction) in which the substantially U-shaped frame portion 9 is open. Accordingly, it may be possible to improve a characteristic of radiating to the direction of the passive element 7 when being viewed from the radiation element 4.

In addition, since a configuration is adopted in which electric power is fed to the radiation element 4 using the coplanar line 5 used in a high-frequency circuit, it may be possible to easily connect the high-frequency circuit and the antenna 1 to each other.

Figure 5:
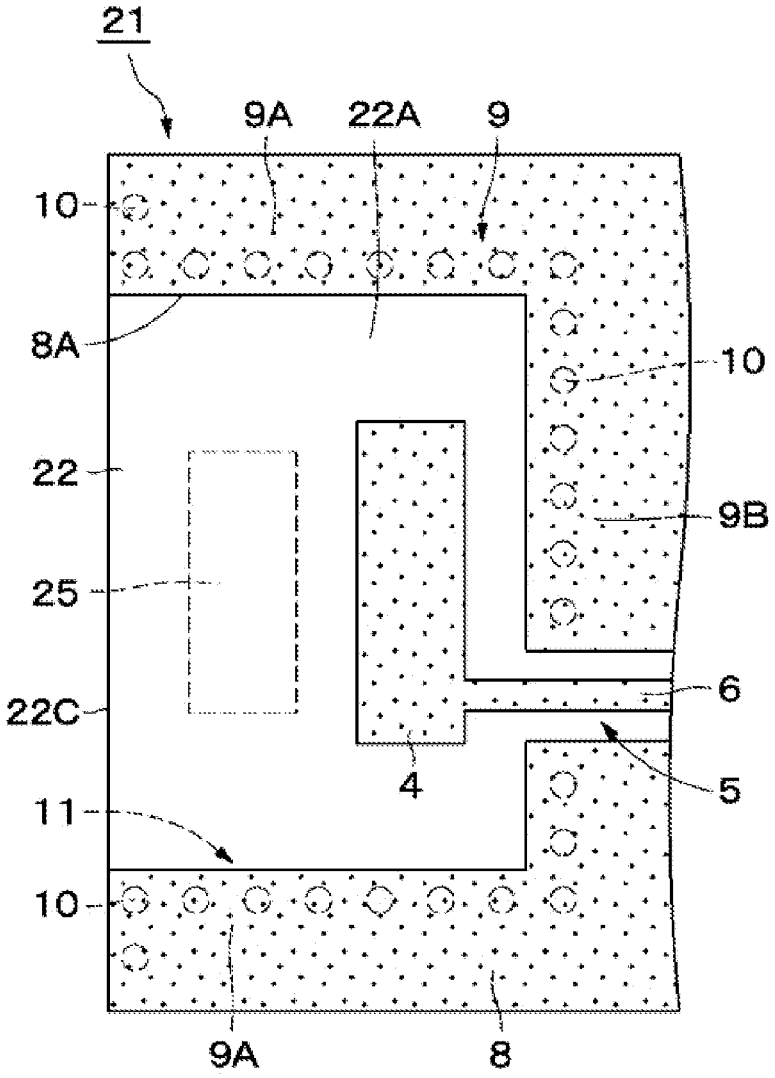
FIG. 5 is a plan view illustrating a horizontal radiation antenna according to a second exemplary embodiment.
Figure 6:
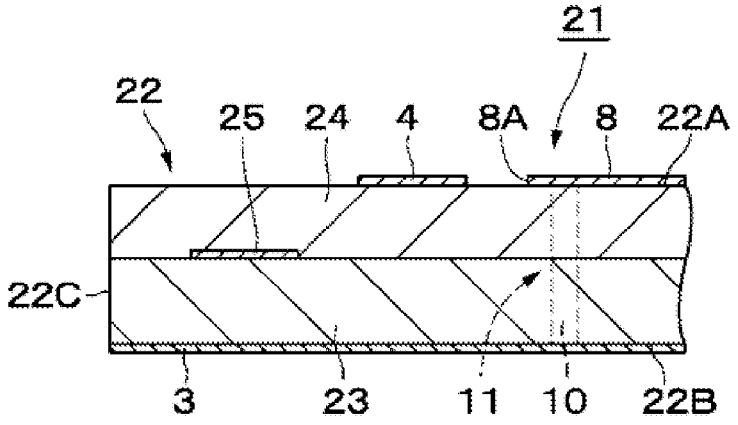
FIG. 6 is a cross-sectional view of a similar position as in FIG. 3, which illustrates the horizontal radiation antenna in FIG. 5.

Next, FIG. 5 and FIG. 6 illustrate a second exemplary embodiment. In addition, the feature of the present embodiment is a configuration in which a passive element and a radiation element are provided at positions different from each other with respect to the thickness direction. In addition, in the present exemplary embodiment, configuration elements having a symbol the same as assigned a configuration element in the first embodiment are described above with respect to the first embodiment, and that description may not repeated here.

A horizontal radiation antenna 21 according to the second exemplary embodiment includes a multilayer substrate 22, the back-surface-side grounded conductor plate 3, a radiation element 4, a passive element 25, a front-surface-side grounded conductor plate 8, and the like.

The multilayer substrate 22 is formed in a similar way as the substrate 2 according to the first exemplary embodiment, for example, in a substantially plate shape extending in parallel to the X axis direction and the Y axis direction. This multilayer substrate 22 can have a width dimension of about several mm with respect to the Y axis direction that corresponds to a width direction, for example, and can have a length dimension of about several mm with respect to the X axis direction that corresponds to a length direction, for example. In addition, the multilayer substrate 22 can have a thickness dimension of about several hundred μm with respect to the Z axis direction that corresponds to a thickness direction, for example.

In addition, the multilayer substrate 22 includes two insulation layers 23 and 24, laminated in the Z axis direction so as to be headed from a back surface 22B side to a front surface 22A side. For example, each of the insulation layers 23 and 24 can be formed in a thin layer using a resin material having an insulation property whose relative permittivity is about 4. For example, the thickness dimension of the multilayer substrate 22 can be set to about 700 μm. In addition, the insulation layers 23 and 24 of the multilayer substrate 22 are not limited to the resin material, and may also be formed using ceramic materials having insulation properties.

In addition, the radiation element 4 and the front-surface-side grounded conductor plate 8 are provided on the front surface 22A of the multilayer substrate 22. In addition, the back-surface-side grounded conductor plate 3 is provided on the back surface 22B of the multilayer substrate 22. Furthermore, the plural vias 10 penetrating in the thickness direction are provided in the multilayer substrate 22. These vias 10 electrically connect the back-surface-side grounded conductor plate 3 and the front-surface-side grounded conductor plate 8 to each other, and form the conductive wall surface 11 between the back-surface-side grounded conductor plate 3 and the front-surface-side grounded conductor plate 8.

The passive element 25 can be formed in approximately a similar way as the passive element 7 according to the first exemplary embodiment. For example, the passive element 25 can be formed in a substantially long and thin quadrangular shape using a similar conductive metal thin film as that of the radiation element 4, and disposed on the end portion side 22C of the multilayer substrate 22 when being viewed from the radiation element 4. In addition, the passive element 25 extends in the Y axis direction in a state in which the passive element 25 is parallel to the radiation element 4, and the passive element 25 is disposed in parallel to the radiation element 4.

As can be seen in FIGS. 5 and 6, however, the passive element 25 is located between the insulation layers 23 and 24 and provided within the multilayer substrate 22. In this regard, the passive element 25 is different from the passive element 7 provided on the front surface 22A of the multilayer substrate 22 according to the first exemplary embodiment. In addition, the passive element 25 is insulated from the radiation element 4, the back-surface-side grounded conductor plate 3, and the front-surface-side grounded conductor plate 8. In addition, in planar view of the horizontal radiation antenna 21, the passive element 25 is disposed within the notch portion 8A along with the radiation element 4.

Accordingly, in the second exemplary embodiment, it may also be possible to obtain a similar function effect as the first exemplary embodiment. In particular, in the second embodiment, since the passive element 25 is disposed at a position different from the radiation element 4 with respect to the thickness direction, it may be possible to adjust the directivity of the horizontal radiation antenna 21 with respect to the thickness direction, for example, in response to the position of the passive element 25 with respect to the thickness direction.

In addition, in the second exemplary embodiment, a configuration is adopted in which the passive element 25 is provided on the back surface 22B side of the multilayer substrate 22, compared with the radiation element 4. However, embodiments consistent with the present disclosure are not limited to this example, and a configuration also can be adopted in which the passive element is provided on the front surface side of the multilayer substrate, compared with the radiation element, for example. In this case, for example, an insulation layer may be provided that covers the radiation element, and a configuration may be adopted in which the passive element is provided on the front surface of this insulation layer.

Figure 7:
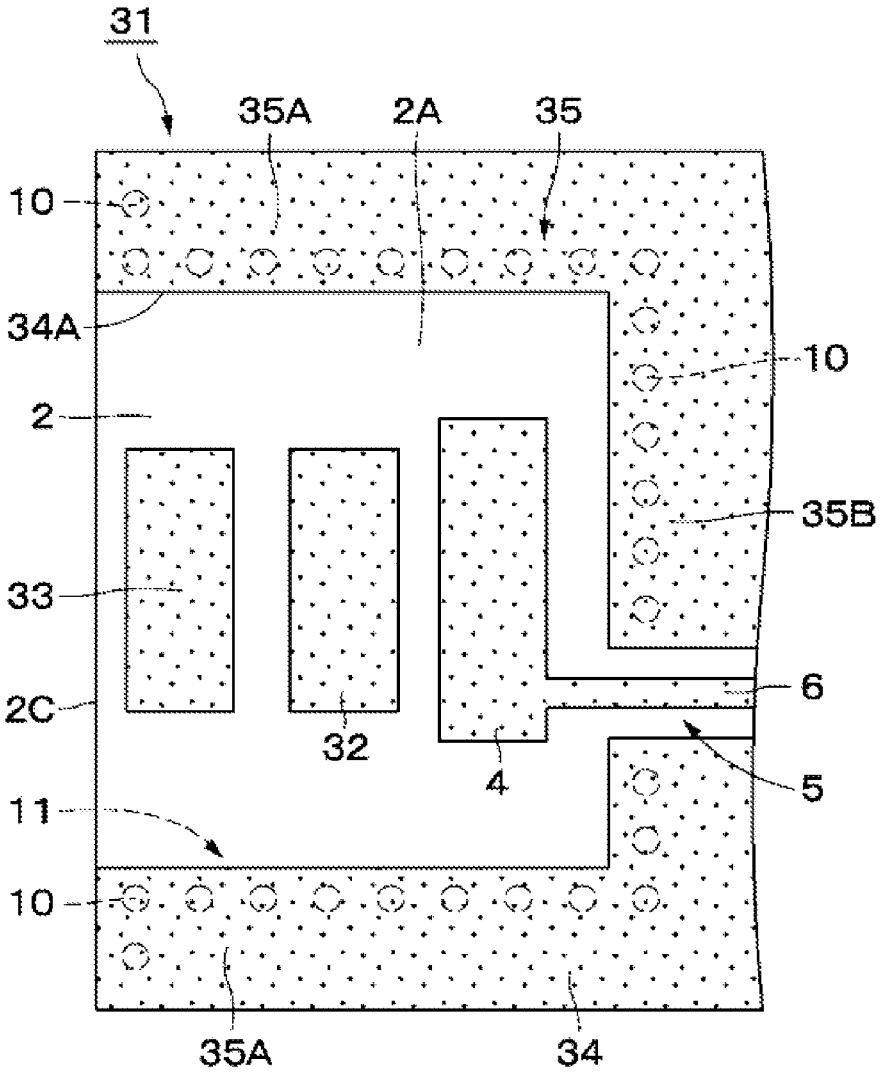
FIG. 7 is a plan view illustrating a horizontal radiation antenna according to a third exemplary embodiment.
Figure 8:
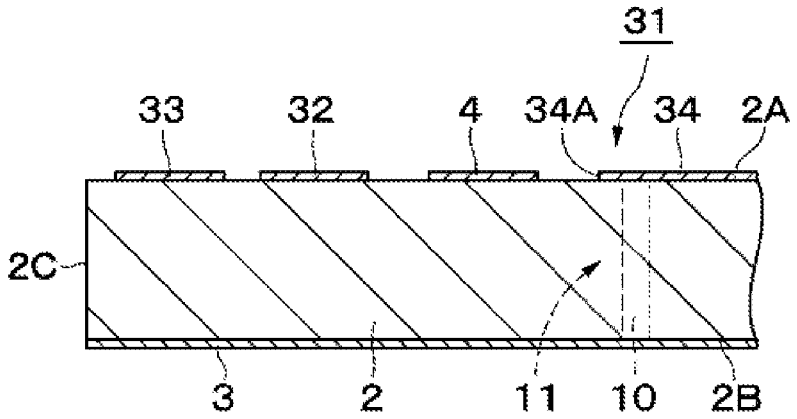
FIG. 8 is a cross-sectional view of a similar position as in FIG. 3, which illustrates the horizontal radiation antenna in FIG. 7.

Next, FIG. 7 and FIG. 8 illustrate a third exemplary embodiment. In addition, the feature of the present embodiment is a configuration in which a plurality of passive elements are provided. In addition, in the present embodiment, configuration elements having a same symbol as assigned a configuration element in the first embodiment are described above with respect to the first embodiment, and that description may not be repeated here.

A horizontal radiation antenna 31 according to the third exemplary embodiment includes a substrate 2, a back-surface-side grounded conductor plate 3, a radiation element 4, passive elements 32 and 33, a front-surface-side grounded conductor plate 34, and the like.

In the present exemplary embodiment, the first passive element 32 is formed in approximately a similar way as the passive element 7 according to the first embodiment. Therefore, for example, the first passive element 32 is formed in a substantially long and thin quadrangular shape, using a conductive metal thin film, and disposed on the end portion side 2C of the substrate 2 when being viewed from the radiation element 4. In addition, a clearance gap is formed between the first passive element 32 and the radiation element 4, the first passive element 32 extends in the Y axis direction in a state in which the first passive element 32 is parallel to the radiation element 4, and thus the first passive element 32 is disposed in parallel to the radiation element 4. In addition, the first passive element 32 is insulated from the radiation element 4, the back-surface-side grounded conductor plate 3, and the front-surface-side grounded conductor plate 34.

In the present exemplary embodiment, the second passive element 33 is formed in approximately a similar way as the first passive element 32. Therefore, for example, the second passive element 33 is formed in a substantially long and thin quadrangular shape, using a conductive metal thin film, and disposed on the end portion side 2C of the substrate 2, compared with the first passive element 32. In addition, a clearance gap is formed between the second passive element 33 and the first passive element 32, the second passive element 33 extends in the Y axis direction in a state in which the second passive element 33 is parallel to the first passive element 32, and thus the second passive element 33 is disposed in parallel to the radiation element 4 and the first passive element 32. In addition, the second passive element 33 is insulated from the radiation element 4, the back-surface-side grounded conductor plate 3, the front-surface-side grounded conductor plate 34, and the first passive element 32.

In the present exemplary embodiment, the front-surface-side grounded conductor plate 34 is formed in approximately a similar way as the front-surface-side grounded conductor plate 8 according to the first exemplary embodiment. Therefore, the front-surface-side grounded conductor plate 34 is provided on the front surface 2A of the substrate 2, and faces the back-surface-side grounded conductor plate 3. This front-surface-side grounded conductor plate 34 is electrically connected to the back-surface-side grounded conductor plate 3 using the plural vias 10. Therefore, the front-surface-side grounded conductor plate 34 is connected to the ground in a similar way as the back-surface-side grounded conductor plate 3.

In addition, in the front-surface-side grounded conductor plate 34, a substantially quadrangular-shaped notch portion 34A is formed that is located on the end portion 2C side of the multilayer substrate 2 and whose leading end side in the X axis direction is open. In planar view of the horizontal radiation antenna 31, the radiation element 4 and the first and second passive elements 32 and 33 are disposed within the notch portion 34A. In addition, around the notch portion 34A, a substantially U-shaped frame portion 35 is formed that has a substantially U-shaped form and surrounds the radiation element 4 and the first and second passive elements 32 and 33. This substantially U-shaped frame portion 35 is configured by two arm portions 35A, which are disposed on both sides in the Y axis direction with sandwiching therebetween the notch portion 34A and extend in the X axis direction, and a width direction extension portion 35B that is located on the inner portion side of the notch portion 34A and extends in the width direction between the two arm portions 35A.

In addition, the plural vias 10 are disposed along the edge portion of the substantially U-shaped frame portion 35 so as to surround the notch portion 34A. Accordingly, the plural vias 10 form the conductive wall surface 11 between the front-surface-side grounded conductor plate 34 and the back-surface-side grounded conductor plate 3.

Accordingly, in the third exemplary embodiment, it may also be possible to obtain a similar function effect as the first exemplary embodiment. In particular, in the third embodiment, because the first and second passive elements 32 and 33 are provided on the end portion side 2C of the substrate 2 compared with the radiation element 4, it may be possible to adjust the directivity of the horizontal radiation antenna 31 in response to the dispositions, the shapes, the sizes, and the like of the first and second passive elements 32 and 33.

In addition, while, in the third exemplary embodiment, a configuration is adopted in which two passive elements 32 and 33 are provided, a configuration may also be adopted in which more than two passive elements are provided.

Figure 9:
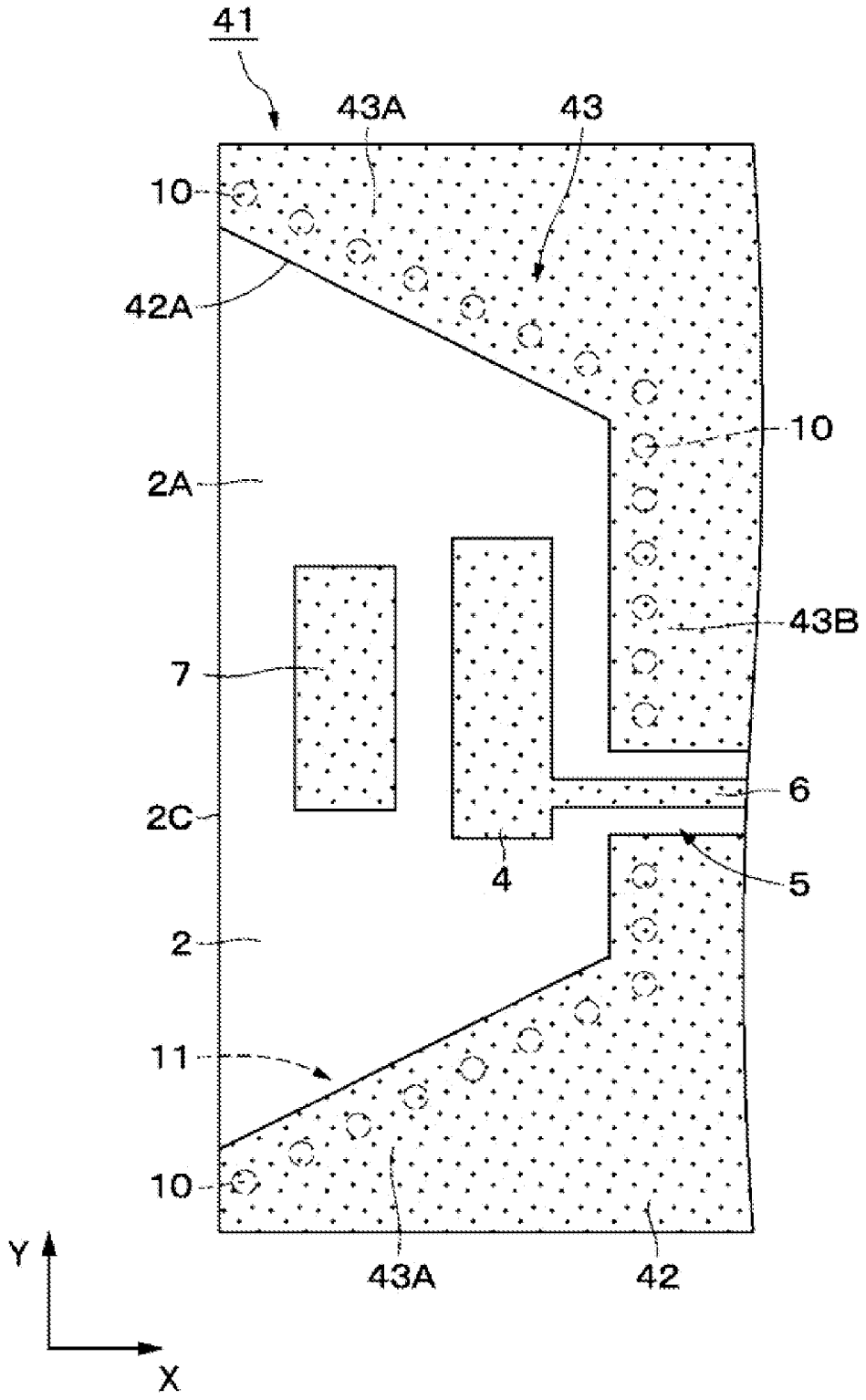
FIG. 9 is a plan view illustrating a horizontal radiation antenna according to a fourth exemplary embodiment.

Next, FIG. 9 illustrates a fourth exemplary embodiment. In addition, the feature of the present embodiment exists in that a notch portion forming a substantially U-shaped frame portion is formed in a substantially trapezoidal shape spreading toward the end portion side 2*c* of a substrate 2. In addition, in the present embodiment, configuration elements having a symbol the same as assigned a configuration element in the first embodiment are described above with respect to the first embodiment, and that description may not repeated here.

A horizontal radiation antenna 41 according to the fourth exemplary embodiment includes the substrate 2, a back-surface-side grounded conductor plate 3, a radiation element 4, a passive element 7, a front-surface-side grounded conductor plate 42, and the like.

The front-surface-side grounded conductor plate 42 is formed in approximately a similar way as the front-surface-side grounded conductor plate 8 according to the first exemplary embodiment. Therefore, the front-surface-side grounded conductor plate 42 is provided on the front surface 2A of the substrate 2, and faces the back-surface-side grounded conductor plate 3. This front-surface-side grounded conductor plate 42 is electrically connected to the back-surface-side grounded conductor plate 3 using the plural vias 10. Therefore, the front-surface-side grounded conductor plate 42 is connected to the ground in a similar way as the back-surface-side grounded conductor plate 3.

In addition, in the front-surface-side grounded conductor plate 42, a substantially trapezoidal-shaped notch portion 42A is formed that is located on the end portion 2C side of the substrate 2 and whose leading end side in the X axis direction is open. As for this notch portion 42A, compared with a bottom portion located on the central side of the substrate 2, the width dimension in the Y axis direction of an aperture portion located on the end portion side 2C of the substrate 2 is large. Namely, the notch portion 42A is broadened and open in a substantially tapered shape with drawing near to the end portion side 2C of the substrate 2.

In planar view of the horizontal radiation antenna 41, the radiation element 4 and the passive element 7 are disposed within the notch portion 42A. In addition, around the notch portion 42A, a substantially U-shaped frame portion 43 is formed that has a substantially U-shaped form and surrounds the radiation element 4 and the passive element 7. This substantially U-shaped frame portion 43 is configured by two arm portions 43A, which are disposed on both sides in the Y axis direction with sandwiching therebetween the notch portion 42A and extend in the X axis direction, and a width direction extension portion 43B that is located on the inner portion side of the notch portion 42A and extends in the width direction between the two arm portions 43A. A distance dimension between the two arm portions 43A gradually increases with drawing near to the end portion side 2C of the substrate 2.

In addition, the plural vias 10 surround the notch portion 42A and are disposed along the edge portion of the substantially U-shaped frame portion 43. Accordingly, the plural vias 10 form the conductive wall surface 11 between the front-surface-side grounded conductor plate 42 and the back-surface-side grounded conductor plate 3.

Accordingly, in the fourth exemplary embodiment, it may also be possible to obtain a similar function effect as the first exemplary embodiment. In particular, in the fourth embodiment, since the notch portion 42A forming the substantially U-shaped frame portion 43 is formed in the substantially trapezoidal shape, it may be possible to adjust the divergence characteristic of a radiation pattern with respect to the Y axis direction, in response to the shape of the notch portion 42A.

Figure 10:
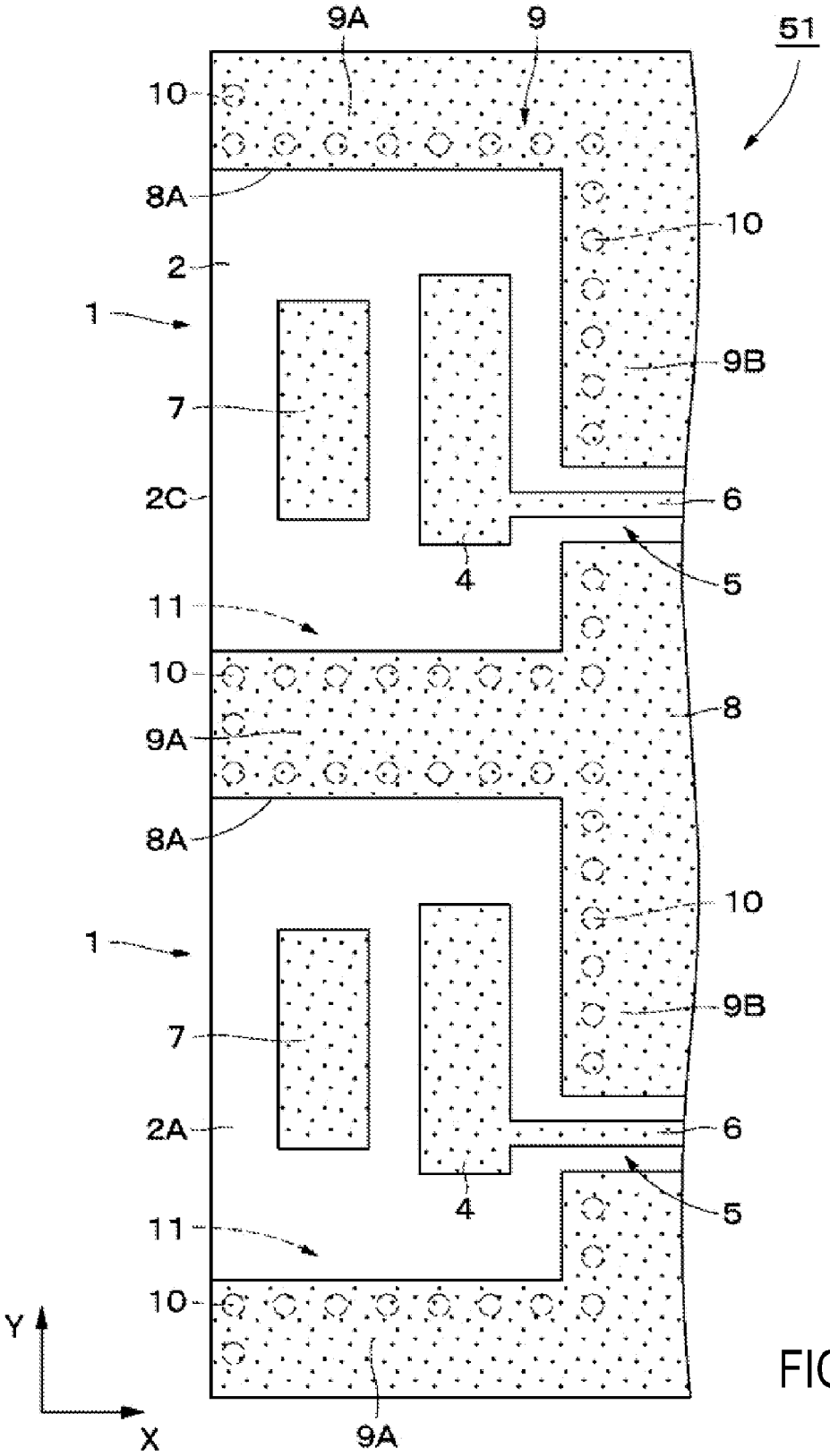
FIG. 10 is a plan view illustrating an array antenna according to a fifth exemplary embodiment.

Next, FIG. 10 illustrates a fifth exemplary embodiment. A feature of the present embodiment is that two horizontal radiation antennae are disposed next to each other in the width direction, thereby configuring an array antenna. In addition, in the present embodiment, configuration elements having a symbol the same as assigned a configuration element in the first embodiment are described above with respect to the first embodiment, and that description may not repeated here.

The two horizontal radiation antennae 1 according to the first exemplary embodiment are disposed next to each other in the Y axis direction, and hence an array antenna 51 according to the fifth exemplary embodiment is formed. In the two horizontal radiation antennae 1, power feeding is performed on the radiation elements 4 through the coplanar lines 5. The phases of the power feeding for the two coplanar lines 5 are allowed to mutually change. Accordingly, it may be possible to change the radiation direction of an electromagnetic wave in response to the phases of the power feeding for the two coplanar lines 5.

Accordingly, in the fifth exemplary embodiment, it may also be possible to obtain a similar function effect as the first exemplary embodiment. In particular, in the fifth embodiment, since the two horizontal radiation antennae 1 are disposed next to each other in the Y axis direction, thereby configuring the array antenna 51, it may be possible to change the radiation direction of an electromagnetic wave by changing the phases of the power feeding for the two coplanar lines 5.

In addition, while, in the fifth exemplary embodiment, the array antenna 51 is configured using the two horizontal radiation antennae 1, the array antenna may also be configured using more than two horizontal radiation antennae. In addition, while, in the fifth embodiment, a configuration is adopted in which the horizontal radiation antenna 1 according to the first exemplary embodiment is used, a configuration may also be adopted in which any one of the horizontal radiation antennae 21, 31, and 41 according to the second to the fourth exemplary embodiments, respectively, is used.

Figure 11:
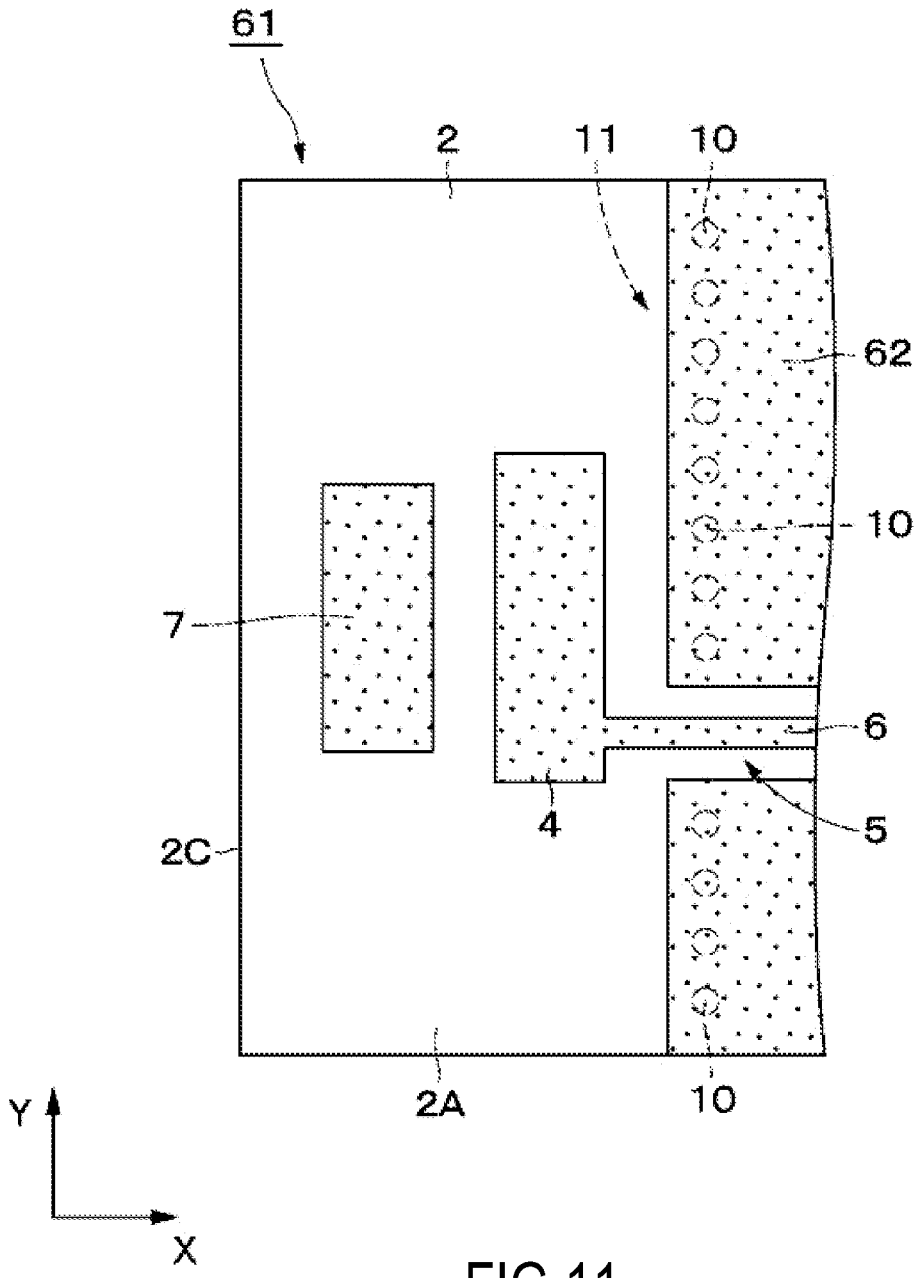
FIG. 11 is a plan view illustrating a horizontal radiation antenna according to a first example of a modification.

In addition, in the individual embodiments described above, configurations are adopted in which the substantially U-shaped frame portions 9, 35, and 43 surrounding the radiation element 4 and the passive elements 7, 25, 32, and 33 are provided in the front-surface-side grounded conductor plates 8, 34, and 42. However, preferred embodiments of the present invention are not limited to the above-mentioned embodiments. For example, FIG. 11 shows in a first example of a modification in which a horizontal radiation antenna 61 has a front-surface-side grounded conductor plate 62 uniform with respect to the Y axis direction. In this case, compared with the end portion side 2C of the substrate 2, the front-surface-side grounded conductor plate 62 is located on a base end side in the X axis direction, and disposed at a coplanar line 5 side without facing the radiation element 4 and the passive element 7. In addition, between the front-surface-side grounded conductor plate 62 and the back-surface-side grounded conductor plate 3, the plural vias 10 are provided next to each other in the Y axis direction. In addition, these plural vias 10 form the conductive wall surface 11 between the front-surface-side grounded conductor plate 62 and the back-surface-side grounded conductor plate 3.

Figure 12:
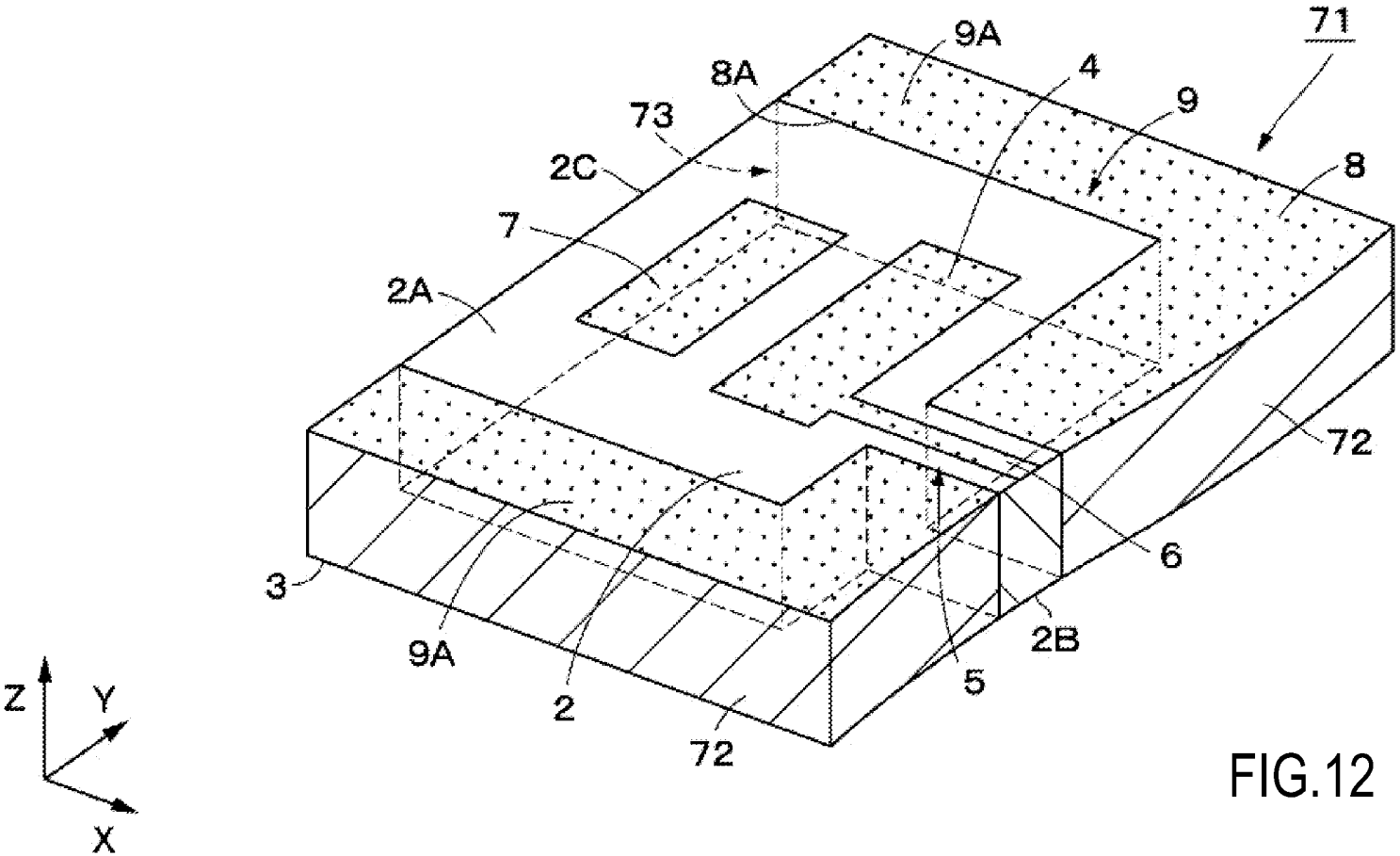
FIG. 12 is a perspective view illustrating a horizontal radiation antenna according to a second example of a modification.
Figure 13:
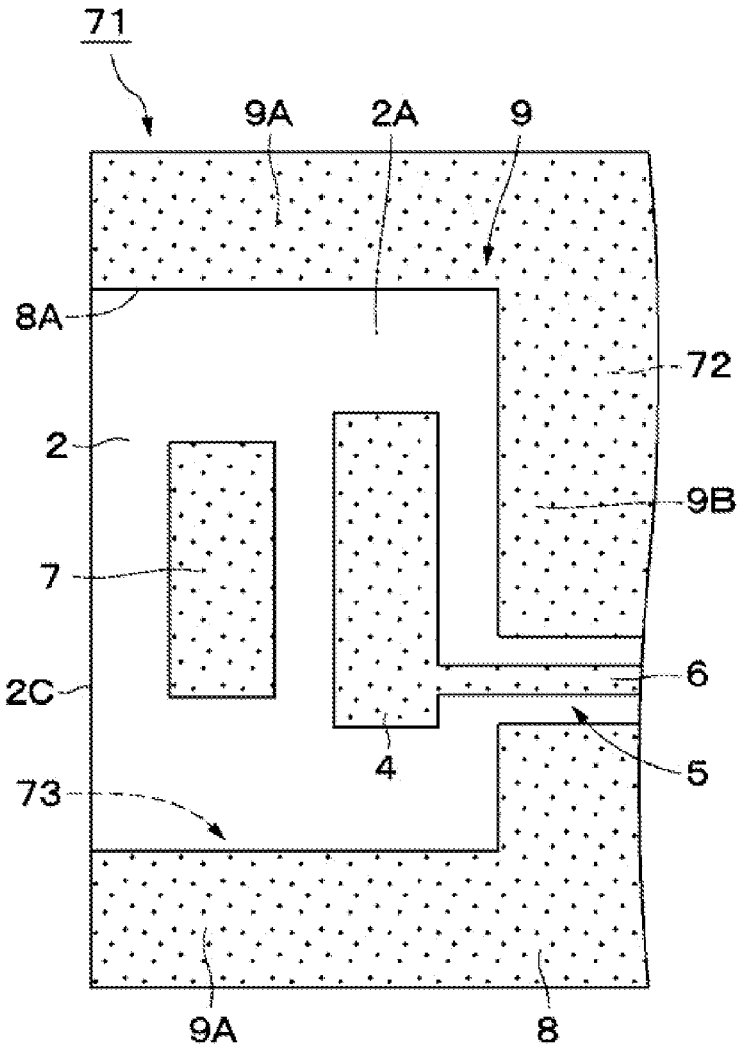
FIG. 13 is a plan view illustrating the horizontal radiation antenna in FIG. 12.
Figure 14:
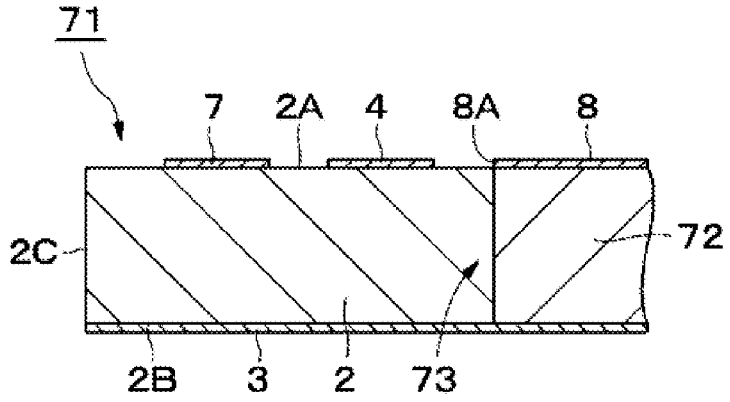
FIG. 14 is a cross-sectional view of a similar position as in FIG. 3, which illustrates the horizontal radiation antenna in FIG. 12.

In addition, in the individual embodiments, configurations are adopted in which electrical connection is established between the front-surface-side grounded conductor plates 8, 34, and 42 and the back-surface-side grounded conductor plate 3 using the plural vias 10 and the conductive wall surface 11 is formed using these plural vias 10. However, preferred embodiments of the present invention are not limited to these embodiments, and a configuration may also be adopted in which, for example, as a horizontal radiation antenna 71 according to a second example of a modification illustrated in FIG. 12 to FIG. 14, a connection conductor plate 72 having the same thickness dimension as that of the substrate 2 is embedded in the substrate 2, and the front-surface-side grounded conductor plate 8 and the back-surface-side grounded conductor plate 3 are connected to each other using the connection conductor plate 72. In this case, the connection conductor plate 72 also has approximately a similar shape as that of the substantially U-shaped frame portion 9 in the front-surface-side grounded conductor plate 8, and a conductive wall surface 73 is formed between the front surface grounded conductor plate 8 and the back-surface-side grounded conductor plate 3 using the end surface of the connection conductor plate 72. In addition, the front-surface-side grounded conductor plate 8 and the connection conductor plate 72 may also be integrally formed.

In addition, while, in the individual embodiments, a case has been cited as an example and described in which the coplanar line 5 is used as a feeding line, a configuration may also be adopted in which a strip line or the like is used, for example.

In addition, while, in the individual embodiments, the horizontal radiation antenna used for a millimeter wave of about a 60 GHz band has been cited as an example and described, the embodiments may also be applied to a horizontal radiation antenna used for a millimeter wave of another frequency band, a microwave, or the like.

In embodiments according to the disclosure, because the passive element is provided in a state in which the passive element is parallel to the radiation element, the passive element serves as an inducer. Therefore, it may be possible to obtain a directivity in the direction of the passive element when being viewed from the radiation element, and it may be possible to radiate an electromagnetic wave from the end portion side of the substrate in a horizontal direction parallel to the substrate. In addition, since the radiation element is provided at a position facing the grounded conductor plate, it may be possible to perform power feeding on the radiation element without using a balun electrode. In addition to this, it may be possible to radiate an electromagnetic wave without using a conductor cover. Therefore, it may be possible to downsize the whole antenna compared with a case in which the balun electrode or the conductor cover is used.

In addition, since the conductive wall surface is provided between the front-surface-side grounded conductor plate and the back-surface-side grounded conductor plate, this wall surface serves as a reflector. As a result, it may be possible to improve a characteristic of radiating to the end portion side of the substrate, on which the passive element is disposed when being viewed from the radiation element. Furthermore, since an electromagnetic wave may be reflected by the wall surface provided between the front-surface-side grounded conductor plate and the back-surface-side grounded conductor plate, it may be possible to prevent electric power from leaking into the inside of the substrate.

According to exemplary configurations in which the front-surface-side grounded conductor includes a substantially U-shaped frame portion, because the substantially U-shaped frame portion surrounds the radiation element and the passive element in a substantially U-shaped form in a state in which the end portion side of the substrate is open, the conductive wall surface between the front-surface-side grounded conductor plate and the back-surface-side grounded conductor plate is also formed in a substantially U-shaped form. Therefore, it may be possible to radiate an electromagnetic wave to the end portion side of the substrate, on which the substantially U-shaped frame portion is open, and in addition to this, it may be possible to prevent an electromagnetic wave from diverging into both end portion sides in the width direction in which the substantially U-shaped frame portion is open. Accordingly, it may be possible to improve a characteristic of radiating to the direction of the passive element when being viewed from the radiation element.

In embodiments in which the feeding line is configured using a coplanar line that includes a strip conductor as the conductor pattern provided on the front surface of the substrate and the front-surface-side grounded conductor plates provided on both sides in a width direction with sandwiching therebetween the strip conductor, because the feeding line is configured using the coplanar line used in a high-frequency circuit, it may be possible to easily connect the high-frequency circuit and the antenna to each other.

In embodiments in which the wall surface is configured using a plurality of vias that are provided so as to penetrate the substrate and electrically connect the front-surface-side grounded conductor plate and the back-surface-side grounded conductor plate to each other, because the plural vias are provided that electrically connect the front-surface-side grounded conductor plate and the back-surface-side grounded conductor plate to each other, it may be possible to form the conductive wall surface between the front-surface-side grounded conductor plate and the back-surface-side grounded conductor plate using these plural vias. Therefore, owing to the conductive wall surface including the plural vias, it may be possible to reflect an electromagnetic wave headed into the inside of the substrate. In addition, conductor patterns are formed in the substrate, via processing is performed on the substrate, and hence it may be possible to form the antenna. Therefore, it may be possible to easily apply this technology to a mass production line.

While preferred embodiments of the invention have been described above, it is to be understood that variations and modifications will be apparent to those skilled in the art without departing from the scope and spirit of the disclosure.

What is claimed is:

1. A horizontal radiation antenna comprising:

a substrate including an insulating material;

a back-surface-side grounded conductor plate on a back surface side of the substrate and connected to ground;

a front-surface-side grounded conductor plate on a front surface side of the substrate and connected to ground;

an elongated and thin radiation element on the front surface side of the substrate and facing the back-surface-side grounded conductor plate and spaced therefrom;

a feeding line including a conductor pattern on the front surface side of the substrate and connected to the radiation element; and at least one passive element closer to an end portion side of the substrate than the radiation element, extending in parallel with the radiation element, and insulated from the back-surface-side grounded conductor plate, the front-surface-side grounded conductor plate, and the radiation element, wherein the front-surface-side grounded conductor plate is disposed at a substantially same height as the radiation element with respect to a thickness direction of the substrate, a conductive wall surface capable of reflecting a high-frequency signal radiated from the radiation element is provided between the front-surface-side grounded conductor plate and the back-surface-side grounded conductor plate, the front-surface-side grounded conductor plate has a substantially U-shaped frame portion surrounding a notch portion positioned on the end portion side of the substrate, and the radiation element and the passive element are entirely disposed within the notch portion.

2. The horizontal radiation antenna according to claim 1, wherein the substantially U-shaped frame portion surrounds the radiation element and the passive element in a state in which the end portion side of the substrate is open.

3. The horizontal radiation antenna according to claim 1, wherein the feeding line is configured using a coplanar line that includes a strip conductor as the conductor pattern provided on the front surface of the substrate and the front-surface-side grounded conductor plates provided on both sides in a width direction with sandwiching therebetween the strip conductor.

4. The horizontal radiation antenna according to claim 2, wherein the feeding line is configured using a coplanar line that includes a strip conductor as the conductor pattern provided on the front surface of the substrate and the front-surface-side grounded conductor plates provided on both sides in a width direction with sandwiching therebetween the strip conductor.

5. The horizontal radiation antenna according to claim 1, wherein the wall surface is configured using a plurality of vias that are provided so as to penetrate the substrate and electrically connect the front-surface-side grounded conductor plate and the back-surface-side grounded conductor plate to each other.

6. The horizontal radiation antenna according to claim 2, wherein the wall surface is configured using a plurality of vias that are provided so as to penetrate the substrate and electrically connect the front-surface-side grounded conductor plate and the back-surface-side grounded conductor plate to each other.

7. The horizontal radiation antenna according to claim 3, wherein the wall surface is configured using a plurality of vias that are provided so as to penetrate the substrate and electrically connect the front-surface-side grounded conductor plate and the back-surface-side grounded conductor plate to each other.

8. The horizontal radiation antenna according to claim 4, wherein the wall surface is configured using a plurality of vias that are provided so as to penetrate the substrate and electrically connect the front-surface-side grounded conductor plate and the back-surface-side grounded conductor plate to each other.

9. The horizontal radiation antenna according to claim 1, wherein the wall surface is configured using a conductive plate extending from the front-surface-side grounded conductor plate to the back-surface-side grounded conductor plate to electrically connect the front-surface-side grounded conductor plate and the back-surface-side grounded conductor plate to each other.

10. The horizontal radiation antenna according to claim 1, wherein the radiation element and the passive element are positioned at different heights with respect to said thickness direction of the substrate.

* * * * *